United States Patent [19]

Andert et al.

[11] Patent Number: 4,949,387

[45] Date of Patent: Aug. 14, 1990

[54] ELECTRO-ACOUSTIC TRANSDUCER UNIT

[75] Inventors: Tomas Andert, Bocholt; Stefan Pieper, Haltern, both of Fed. Rep. of Germany

[73] Assignee: Siemens Aktiengesellschaft, Berlin and Munich, Fed. Rep. of Germany

[21] Appl. No.: 363,519

[22] Filed: Jun. 8, 1989

[30] Foreign Application Priority Data

Jul. 29, 1988 [DE] Fed. Rep. of Germany ..... 3825973

[51] Int. Cl.[5] ..... H04R 17/00

[52] U.S. Cl. ..... 381/190; 381/159; 310/324

[58] Field of Search ..... 381/190, 173, 159, 191, 381/163; 310/324; 379/420

[56] References Cited

FOREIGN PATENT DOCUMENTS 1188657 3/1965 Fed. Rep. of Germany ..... 381/159

*Primary Examiner*—Jin F. Ng
*Assistant Examiner*—M. N. McGeary, II
*Attorney, Agent, or Firm*—Hill, Van Santen, Steadman & Simpson

[57] ABSTRACT

An electro-acoustic transducer unit for use either as a microphone, a receiver or a voice frequency ringing transducer has a transducer plate fastened between bearing members provided with a piezo-electric layer. By carefully dimensioning the resonator chambers in front of and behind the transducer plate and providing one resonator space with a neck closed by a covering, which is removable, the transducer may be used as a receiver or a microphone or, by removal of the covering, may be used as a voice frequency ringing transducer. The transducer unit is particularly applicable as an electro-acoustic transducer in telephone technology.

7 Claims, 1 Drawing Sheet

ELECTRO-ACOUSTIC TRANSDUCER UNIT

BACKGROUND OF THE INVENTION

1. Field of the Invention

The present invention relates generally to a an electroacoustic transducer unit for use in communication terminals.

2. Background of the Related Art

In communication terminals, such as telephone stations, three electro-acoustic transducers are necessary, namely a microphone, a receiver, and a signaling device such as a voice frequency ringing transducer. Using the piezo-electric principle, all of these transducers operate according to the same scheme. In the case of microphone, the transducer plate is provided with a piezoelectric layer and an unpitched sound is directed against the transducer plate, which converts the sound into an alternating current. In the case of a receiver and a voice frequency ringing transducer, it is vice versa. In other words, an alternating electric signal is directed to the piezoelectric layer so that a sound is produced. However, voice frequency ringing differs from the operating of a receiver basically in that it radiates certain frequencies at a particularly loud amplitude. Thus, the natural resonance of the transducer diaphragm and the resonance of the acoustic spaces is preferably utilized rather than controlled. In the case of a receiver and a microphone, however, the resonance of the membrane is dampened to gain a uniform frequency response.

To lower the costs for storing and manufacturing, it is desirable to use the same type of electro-acoustic transducer for a microphone, a receiver, and a voice frequency ringing transducer.

SUMMARY OF THE INVENTION

It is an object of the present invention to provide a transducer unit which can be used as a microphone, a receiver and as a voice frequency ringing unit using the piezo-electric principle.

According to the invention, these and other objects are achieved in that a first resonator is provided constituted by volume arranged on one side of a transducer plate, the volume being coupled to an outer volume through sound transmission apertures. A further resonator is constituted of a volume arranged on the other side of the transducer plate that is acoustically connected to the first resonator. The further resonator has a neck portion that is closed by a covering. The further resonator is also connected to a last resonator via coupling apertures. The arrangement represents a transducer that can be used either as a microphone or as a receiver, or the covering over the neck is detachable for use of the transducer as a voice frequency ringing transducer.

The acoustic coupling of the various spaces, or volumes, of the resonators with each other makes it possible, given a closed neck, to create a transducer unit for use as a microphone and for a receiver and, after the removal of the seal by breaking out the covering, the transducer is converted into a voice frequency ringing transducer in a simple manner. In other words, the resonance frequencies are damped by the covering over the neck for a relatively smooth frequency response. By removal of the covering, the natural resonances of the unit are exploited for ringing.

An acoustic coupling between the volumes on both sides of the transducer plate is preferably provided by a nozzle, or channel, provided in the transducer plate.

The nozzle, or channel, is of a dimension within the range of sizes that are usual for receivers and microphones.

It is furthermore possible to provide a sound channel that is led around fastening means for the transducer plate instead of the nozzle so as to provide an acoustic connection between the first resonator and the further resonator.

For the exact tuning of the oscillator behavior, it is furthermore useful to store the transducer plate either in a nonrigid or in a rigid state, which can be determined by tests.

DETAILED DESCRIPTION OF THE PREFERRED EMBODIMENTS

Figure 1:
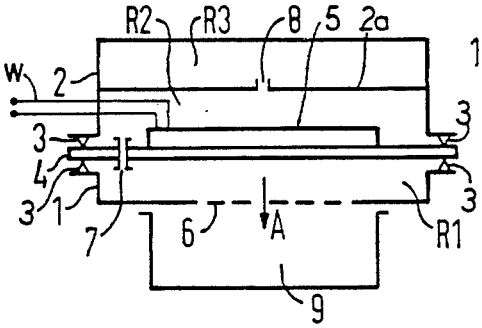
FIG. 1 is a schematic cross section from the side of a receiver.

A receiver is shown in FIG. 1 composed of two housing parts 1 and 2. Between the housing parts 1 and 2 is fastened a transducer plate 4 via storing, or bearing, members 3. A piezoelectric layer 5 is provided on one surface of the transducer plate 4 connectable by wires W to a signal source (not shown). A sound radiating side of the transducer of FIG. 1 is marked by an arrow A whereby the first housing part 1 has sound transmission apertures 6 through which sound waves A are transmitted. Between the sound transmission aperture 6 and the transducer plate 4 is a space, or volume, which forms a first resonator R1.

A second resonator R2 is created by a volume lying behind the transducer plate 4. The resonators R1 and R2 are acoustically connected to one another through a large nozzle, or channel, 7 arranged in the transducer plate 4. The second resonator R2 is followed by yet another resonator R3 which is coupled with the second R2 via a coupling aperture 8, shown at the center of a partition 2*a*. Finally, a coupling volume 9 is shown which models the ear of the user. The illustrated transducer system is balanced to achieve a level frequency response.

Figure 2:
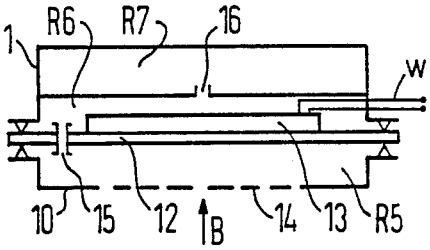
FIG. 2 is a schematic cross section of a microphone using the transducer of FIG. 1.

A microphone is shown in FIG. 2 which has many of the same basic parts as the receiver of FIG. 1. In particular, a two piece housing 10 and 11 is shown between which the transducer plate 12 is mounted. The transducer plate 12 is provided with a piezo-electric layer 13 to which wires W are connected and sound transmission apertures 14 are provided in the housing part 10. The path of sound waves which are detected by the microphone is indicated by arrow B in FIG. 2 entering the apertures 14. Similar to the receiver of FIG. 1, a resonator R5 in front of the transducer plate 12 is acoustically connected to a second resonator R6 behind the transducer plate 12 via a nozzle, or channel, 15 which is, however, smaller compared to the receiver of FIG. 1. Furthermore, a further third resonator R7 is connected with the second resonator R6 via a coupling aperture 16. Together with the coupling aperture 16, the resonator R6 constitutes a strongly damped Helmholtz resonator.

Figure 3:
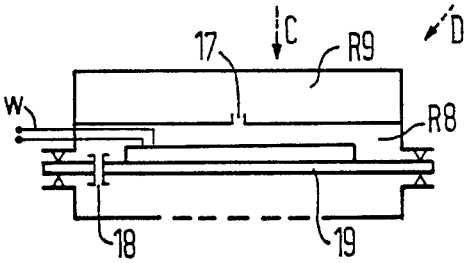
FIG. 3 is a side schematic cross section of a transducer unit as a receiver and a microphone.

In FIG. 3 is shown a uniform transducer for a receiver and a microphone. The arrows C and D indicate that the transducer derives from the transducers according to FIGS. 1 and 2. A nozzle, or channel, 18 is dimensioned so that it represents a medium size somewhere between the size of the nozzle 7 and the nozzle 15 of the receiver and the microphone, respectively. A resonator R8, together with a coupling aperture 17 that is connected to a resonator R9, constitutes a Helmholtz resonator which damps the resonance frequency of a transducer plate 19, which here lies at approximately 1800 Hz. The illustrated transducer plate 19 has the same geometry as in the embodiments of FIGS. 1 and 2 and the same resonance frequency (for a receiver-microphone). However, the receiver as illustrated in FIG. 1 operates with a coupling volume 9 (the ear) sealing in the air to oppose the motion of the transducer plate 4 by damping the motion thereof. Therefore, the resonance frequency of the transducer plate is higher when applied as a receiver that it is in the case of a microphone. Since, however, the Helmholtz resonator is designed in a relatively broad band fashion, a slight detuning barely leads to a slightly higher irregularity in the frequency response characteristic.

Figure 4:
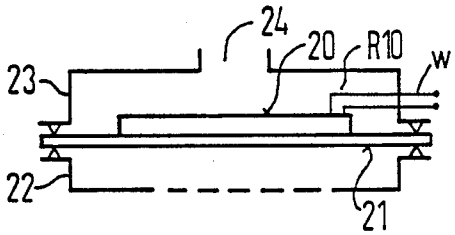
FIG. 4 is a side schematic cross section of a voice frequency ringing transducer.

A voice frequency (VF) ringing unit is illustrated in FIG. 4 which basically differs from the receiver and microphone of FIGS. 1 and 2, respectively, in that it transmits certain frequencies in a particularly loud fashion. The natural resonance of a transducer plate 21 and acoustic resonance of the acoustical spaces is thereby preferred. The voice frequency ringing unit is composed of a piezoceramic layer 20 arranged on the transducer plate 21. The transducer plate 21 is held fastened at its margins or edges between first and second housing parts 22 and 23. The second housing part 23, together with the transducer plate 21 forms a volume R10 of a resonator which has an opening 24 at its center, the opening constituting a neck. The resonator volume R10 and the opening 24 form a Helmholtz resonator. The transducer plate 21 has a resonance frequency of approximately 1.8 Kz. The resonance frequency of the Helmholtz resonator R10 is determined so that it lies a few hundred Hz to the side of the resonance frequency of the transducer plate 21.

Figure 5:
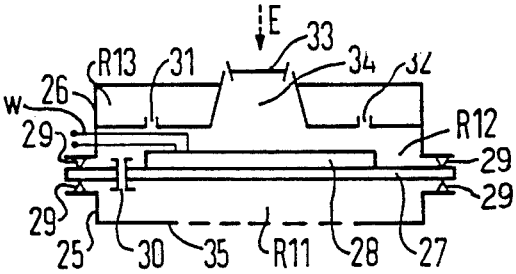
FIG. 5 is a schematic cross section a transducer unit for operation as a receiver, a microphone, or a voice frequency ringing unit.

As indicated by the arrows E and F, the transducer unit shown in FIG. 5 is derived from the transducer units shown in FIGS. 3 and 4. Again, housing parts 25 and 26 are shown, between which a transducer plate 27 is held in place by bearing members 29. The housing part 25 has sound transmission aperture 35. The transducer plate 27 carries a piezoceramic layer 28 which is connected therewith in a mechanically rigid manner. A resonator space R11 is connected to a second resonator space R12 via a nozzle, or channel, 30. Via one or more coupling apertures 31 and 32, a second resonator space R12 is connected to a third resonator space R13.

A neck 34 is provided for the second resonator space R12 which is closed off by a covering 33 so that the coupling apertures 31 and 32 together with the resonator R12 constitutes a Helmholtz resonator. This arrangement may be used as either a receiver or as a microphone.

If the arrangement of FIG. 5 is to be used as a voice frequency ringing transducer, the covering 33 is removed to open the neck 34 to the outside. The result of the removal of the covering 33 is to provide a slightly damped resonator. The coupling apertures 31 and 32 are then ineffective. The covering 33 is, for example, a tear-away covering.

Figure 6:
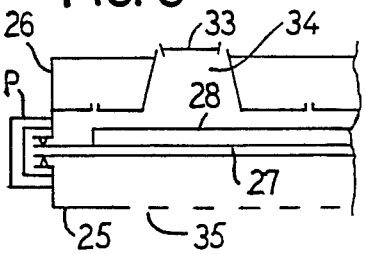
FIG. 6 is another embodiment of the invention.

Instead of the channel 30 being formed in the diaphragm 27, it is possible to provide an external passageway P around the diaphragm, such as shown in FIG. 6.

Although other modifications and changes may be suggested by those skilled in the art, it is the intention of the inventors to embody within the patent warranted hereon all changes and modifications as reasonably and properly come within the scope of their contribution to the art.

We claim:

1. An electro-acoustic transducer unit for communications terminals, comprising:
bearing members;
a transducer plate fastened to said bearing members;
a piezo-electric layer on a surface of said transducer plate;
a two part housing having sound transmission apertures, said two part housing enclosing and supporting said transducer plate via said bearing members;
a first resonator in said housing comprising a first volume a first side of said transducer plate, said first volume being coupled to an outer volume outside said housing through said sound transmission apertures;
a second resonator in said housing comprising a second volume on a second side of said transducer plate opposite said first side, said second volume being acoustically coupled to said first resonator, said second resonator having a neck;
a covering closing said neck of said second resonator; and
a third resonator connected to said second resonator via coupling apertures.

2. An electro-acoustic transducer unit as claimed in claim 1, further comprising:
a nozzle in said transducer plate for acoustically connecting said first and second resonators.

3. An electro-acoustic transducer unit as claimed in claim 1, further comprising:
a sound channel leading around said bearing members means for acoustically connecting said first and second resonators.

4. An electro-acoustic transducer unit as claimed in claim 1, wherein said covering is detachable from said neck.

5. An electro-acoustic transducer unit as claimed in claim 1, wherein said transducer plate is stored in non-rigid fashion.

6. An electro-acoustic transducer unit as claimed in claim 1, wherein said transducer plate is stored in rigid fashion.

7. An electro-acoustic transducer unit for use as a microphone, as a speaker, or as a voice frequency ringing unit, comprising:
a two part housing;
a transducer plate affixed between first and second parts of said two part housing;
a first resonant chamber in said housing on a first side of said transducer plate;
a second resonant chamber on a second side of said transducer plate;
means acoustically coupling said first and second resonant chambers;

a third resonant chamber on an opposite side of said second resonant chamber from said transducer plate;

means acoustically coupling said second and third resonant chambers; and a selectively openable opening in said second resonant chamber, said opening being closed during use of said transducer as a microphone or speaker and being open during use of said transducer as a ringing unit.

* * * * *